US010408579B1

(12) United States Patent
Foltz et al.

(10) Patent No.: US 10,408,579 B1
(45) Date of Patent: Sep. 10, 2019

(54) DIRECTED ENERGY MODIFICATION TO M4A1 BLANK FIRING ADAPTOR (BFA)

(71) Applicant: U.S. Government as Represented by the Secretary of the Army, Picatinny Arsenal, Dover, NJ (US)

(72) Inventors: Adam L. Foltz, Long Valley, NJ (US); James E. Burke, Oak Ridge, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/141,117

(22) Filed: Sep. 25, 2018

Related U.S. Application Data

(63) Continuation-in-part of application No. 15/205,211, filed on Jul. 8, 2016, now Pat. No. 10,180,309, which is a continuation-in-part of application No. 14/487,205, filed on Sep. 16, 2014, now abandoned.

(51) Int. Cl.
*F41H 13/00* (2006.01)

(52) U.S. Cl.
CPC ..... *F41H 13/0075* (2013.01)

(58) Field of Classification Search
CPC .... F41H 13/0075; F41H 13/0093; F41A 5/18; F41A 19/30; F41A 21/38; F41A 3/26; F41A 5/30; F41A 15/12; F41A 19/58; F41A 19/60; F41A 19/59; F41A 19/63; F41A 19/64; F41A 19/68; F41A 19/69; F41A 27/28; G01S 7/495
USPC ..... 89/1.1
See application file for complete search history.

(56) References Cited

U.S. PATENT DOCUMENTS 2,398,642 A * 4/1946 Homrighous ..... H04N 5/06 313/365
2,407,065 A * 9/1946 Jensen ..... H01Q 19/06 333/24 R
2,472,136 A * 6/1949 Whitlock ..... F41A 17/08 342/45
3,102,553 A * 9/1963 Ottestad ..... F16K 17/10 137/505.13
3,125,733 A * 3/1964 Holinbeck ..... H01P 3/00 102/206
3,198,074 A * 8/1965 Perkins ..... F41A 19/58 42/84
3,257,905 A * 6/1966 Weisman ..... F42D 1/04 290/1 R (Continued)

OTHER PUBLICATIONS

Max Teodorescu, US Army devises electricity cannon attachment for the M4 rifle—fries enemy electronics , Apr. 24, 2015, Electronic Products, https://www.electronicproducts.com/Military/Weapons/US_Army_devises_electricity_cannon_attachment_for_the_M4_rifle_fries_enemy_electronics.aspx, pp. 1-2 (Year: 2015).*

*Primary Examiner* — Joshua E Freeman
*Assistant Examiner* — Bridget A Cochran
(74) *Attorney, Agent, or Firm* — Michael C Sachs

(57) ABSTRACT

A one man portable electronic pulse generator includes a standard rifle having a muzzle and capable of firing a blank cartridge containing propellant. A blank firing adapter is fixed to the muzzle of the rifle. A piezoelectric generator is aligned with the gas exit orifice of the blank firing adapter. A lead cable is electrically connected from the piezoelectric generator to a unit in series with said lead cable for storing or utilizing said electronic pulse.

2 Claims, 8 Drawing Sheets

(56) References Cited

U.S. PATENT DOCUMENTS 3,337,760 A * 8/1967 Allport ..... H02K 35/04 290/1 R
3,466,761 A * 9/1969 Stinchcomb ..... F41G 3/32 398/107
3,573,676 A * 4/1971 Mayer ..... H01B 11/12 178/45
3,636,390 A * 1/1972 Stauder ..... F42C 11/04 290/1 R
3,746,881 A * 7/1973 Fitch ..... H03K 3/537 307/108
3,854,231 A * 12/1974 Broyles ..... F41A 19/62 102/501
3,922,968 A * 12/1975 Conger ..... F42B 12/36 102/207
3,973,500 A * 8/1976 Brede ..... F42C 11/04 102/209
4,510,935 A * 4/1985 Spencer ..... H02N 2/18 310/339
4,594,521 A * 6/1986 Schlicher ..... F41B 6/00 290/1 R
4,738,411 A * 4/1988 Ahlstrom ..... F41G 3/145 244/3.15
4,845,378 A * 7/1989 Garbe ..... H01T 1/00 307/106
4,862,021 A * 8/1989 LaRocca ..... F02G 1/0435 310/10
5,818,132 A * 10/1998 Konotchick ..... H02K 35/02 310/17
6,322,365 B1 * 11/2001 Shechter ..... F41A 33/02 434/19
6,477,932 B2 * 11/2002 Jung ..... F41H 13/0068 89/1.11
6,744,154 B2 * 6/2004 Leitner-Wise ..... H02K 7/1869 290/1 R
6,856,238 B2 * 2/2005 Wootton ..... F41A 17/063 340/10.1
7,111,559 B1 * 9/2006 MacLachlan ..... F41H 11/08 102/502
7,380,488 B1 * 6/2008 Mao ..... F41A 5/18 42/77
7,560,855 B2 * 7/2009 Baird ..... H02N 2/183 310/339
7,690,288 B2 * 4/2010 Calico ..... F42C 11/02 102/210
8,205,555 B1 * 6/2012 Rastegar ..... D21F 1/0027 102/210
9,212,861 B2 * 12/2015 Panak ..... F41A 21/36
9,391,596 B2 * 7/2016 Campbell ..... H03K 3/012
9,500,447 B1 * 11/2016 Cannon, Jr. ..... F41H 13/0075
10,088,288 B1 * 10/2018 Caska ..... F42C 11/06
2003/0030280 A1 * 2/2003 Leitner-Wise ..... H02K 7/1869 290/1 R
2009/0108845 A1 * 4/2009 Kaminski ..... G01V 3/082 324/337
2013/0145670 A1 * 6/2013 Kuhlman ..... F41A 19/59 42/84
2016/0131450 A1 * 5/2016 Berg ..... F41A 19/59 42/69.01

* cited by examiner

500

600

DIRECTED ENERGY MODIFICATION TO M4A1 BLANK FIRING ADAPTOR (BFA)

CROSS REFERENCE TO RELATED APPLICATIONS

This application is a continuation-in-part of commonly assigned application Ser. No. 15/205,211 filed Jul. 8, 2016 entitled ELECTROMAGNETIC PULSE TRANSMITTER MUZZLE ADAPTOR which application is in itself a continuation in part of commonly assigned application Ser. No. 14/487,205 filed Sep. 16, 2014 entitled ELECTROMAGNETIC PULSE TRANSMITTER MUZZLE ADAPTOR, which complete patent applications and their the wrapper contents are all hereby incorporated by reference as though fully set forth.

U.S. GOVERNMENT INTEREST

The inventions described herein may be made, used, or licensed by or for the U.S. Government for U.S. Government purposes.

BACKGROUND OF INVENTION

A need exists for a warfighter in remote locations to artificially generate high peak voltages when the usual power sources are unavailable to function needed devices. Certain explosive pulse power applications, for example, have large power sources that need to be vehicle towed. Some pulse power sources (i.e., Marx generators) require a battery for recharge purposes. Electrical energy may be needed yet be unavailable for charging capacitor-based systems or perhaps to initiate devices such as the Marx generator remotely in the field. This need has to date remained not adequately satisfied.

BRIEF SUMMARY OF INVENTION

The invention assists by converting mechanical energy into electrical energy for charging capacitor-based systems or to initiate devices such a Marx generator. This invention might also serve as a charging supply for directed energy sources. This invention utilizes high pressure gas from an ignited M200 5.56 mm blank round in a carbine barrel to supply mechanical force into a ferroelectric pulse generator. The invention combines a modified M 24 Blank Firing Adaptor (BFA) and a machined housing that holds a ferroelectric generator (FEG) and it mounts to a standard M4A1 Carbine. This invention will allow the warfighter to provide a dismounted portable solution for a portable pulse power source. It converts unused mechanical energy of blank ammunition in small arms weapons into electrical energy. This invention eliminates need for modification to the existing weapon system; one maintains ability to change from pulse power generation back to ordinary live fire (such as of ball rounds).

OBJECTS OF THE INVENTION

Accordingly, it is an object of the present invention to provide means for a warfighter in remote locations to artificially generate high peak voltages by rifle fire when the usual power sources are unavailable.

Another object of the present invention is to use high pressure gas from an ignited M200 5.56 mm blank round in a carbine barrel to supply mechanical force into a ferroelectric pulse generator, for voltage generation.

It is a further object of the present invention to utilize a modified M4 Carbine M24 Blank Firing Adapter (BFA) in order to supply mechanical force to a piezoelectric element upon firing of a blank cartridge, for peak voltage generation.

It is yet another object of the present invention to utilize firing of blank cartridges in various weapons to provide voltage generation.

These and other objects, features and advantages of the invention will become more apparent in view of the within detailed descriptions of the invention, the claims, and in light of the following drawings and/or tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

In the drawings, which are not necessarily to scale, like or corresponding parts are denoted by like or corresponding reference numerals.

Figure 7:
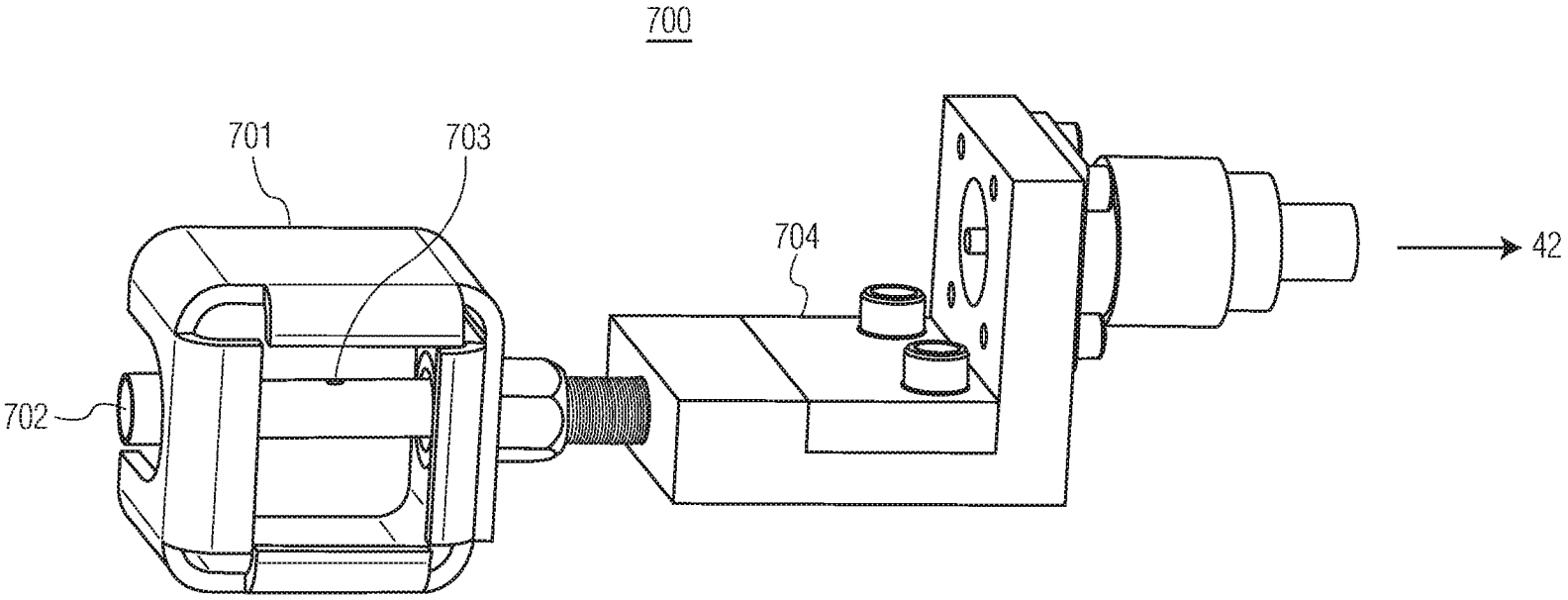

FIG. 7 shows an assembly 700 of one embodiment of the invention where a modified BFA, 701, is arranged to fire through 702, with over pressure hole 703, and out into a piezoelectric device 704 generating a voltage along a, cable wire 42.

Figure 8:
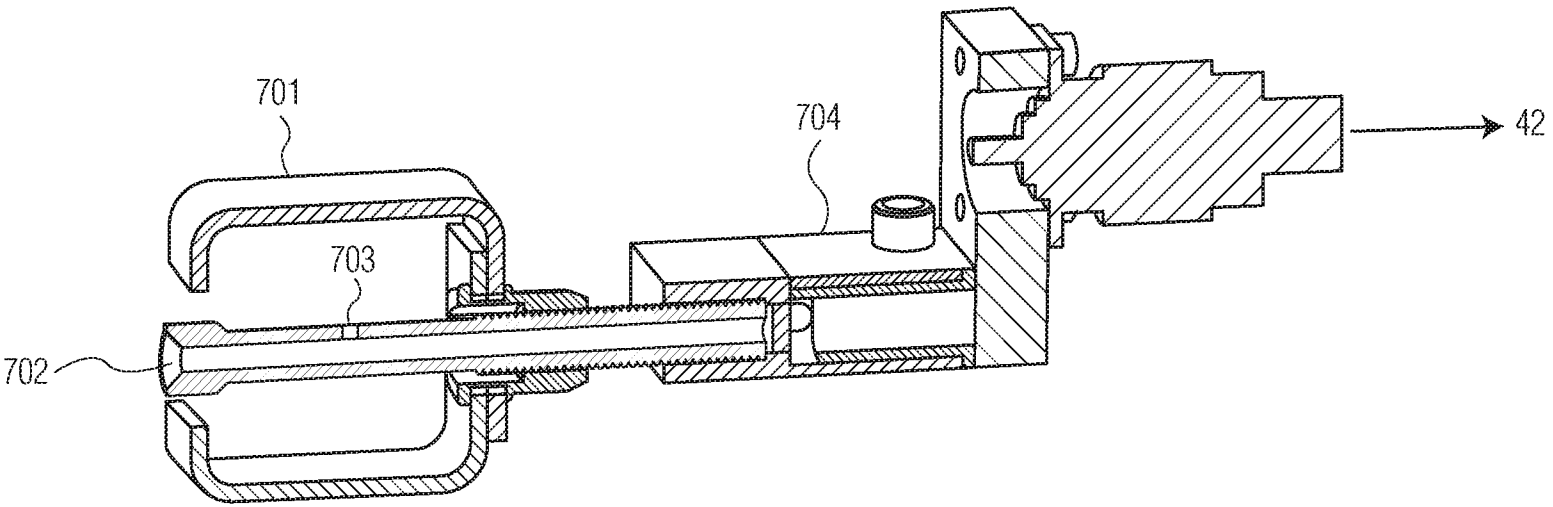

FIG. 8 shows a section view of the FIG. 7 modification to the M4A1 BFA.

Figure 9:
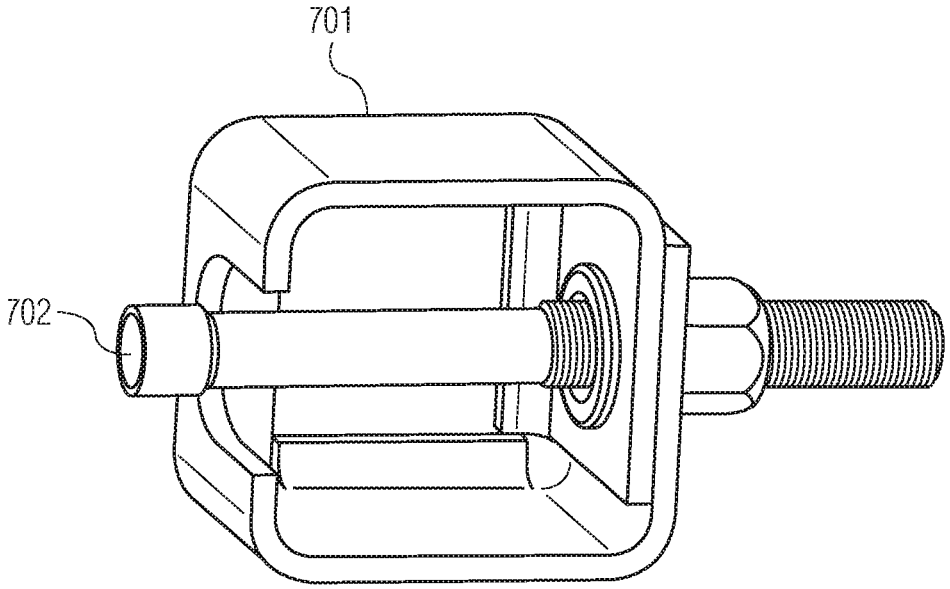

FIG. 9 shows an outside view of a modified M23 BFA.

Figure 10:
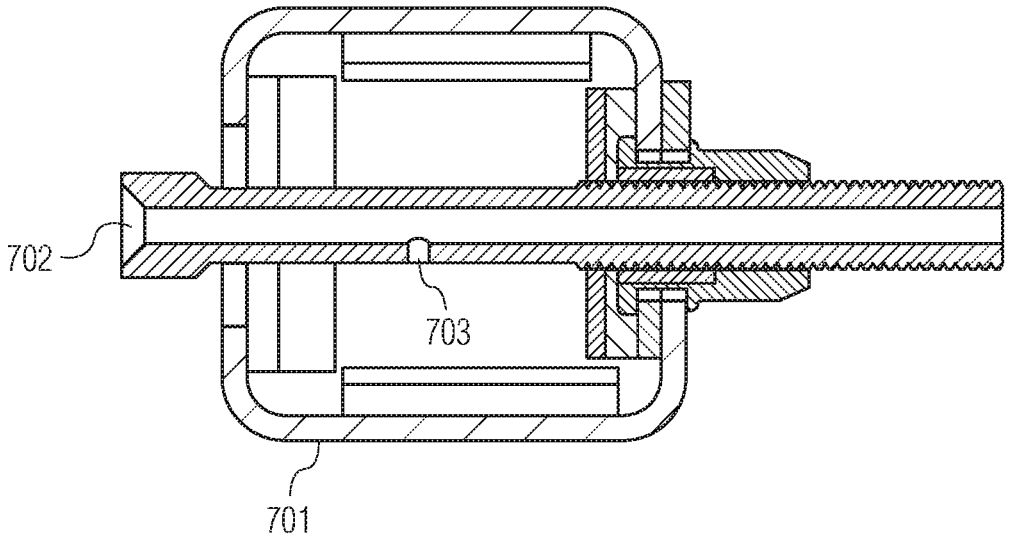

FIG. 10 shows a section view of the modified M23 BFA of FIG. 9.

Figure 11:
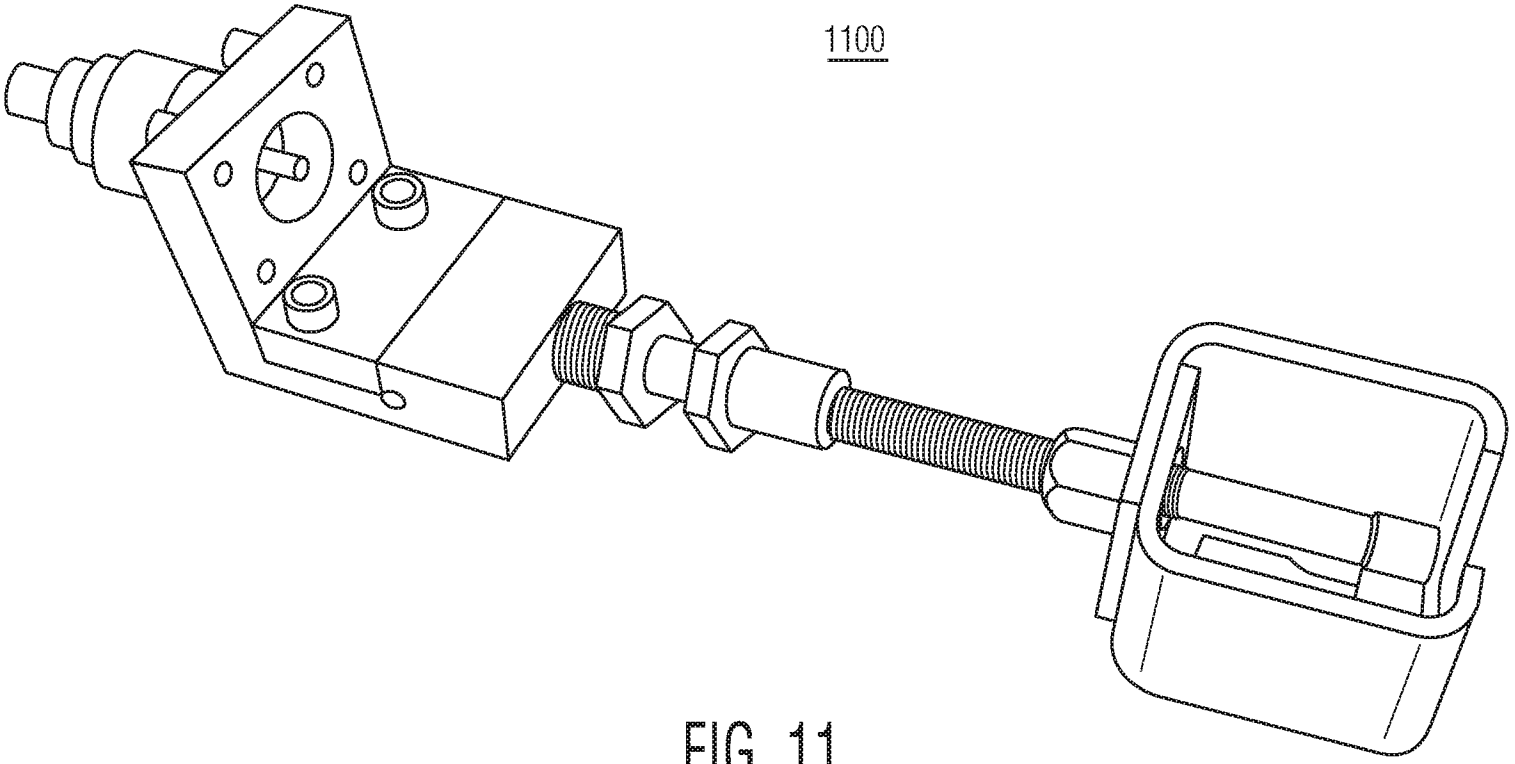

FIG. 11 shows assembled hardware 1100 of an embodiment of the invention where a modified BFA is arranged to fire through, and out into a piezoelectric device.

DETAILED DESCRIPTION

A novel portable adapted pulse gun 10 uses the explosive pulse power from a blank firearm cartridge to supply mechanical force to a ferroelectric element. The blank firearm cartridge may be fired from, for example, a rifle. The rifle may be an unmodified standard issue U.S. Army M4

5.56 mm caliber rifle. Other calibers of rifles may also be used, A blank firing adapter (BFA) is attached to the muzzle of the rifle. The ferroelectric element transforms the mechanical energy created by firing the blank cartridge to an electrical pulse of energy. The electrical pulse of energy is carried through a cable line 42 to power up a select device 43.

Figure 5:
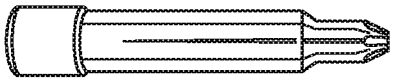
FIG. 5 shows a blank fire round of ammunition 500.
Figure 6:
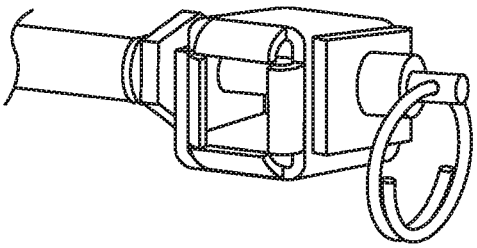
FIG. 6 shows a M200/M24 blank fire adaptor ("BFA") device 600.

The proposed invention intends to utilize the explosive pulse power from a M200 5.56 mm blank round by modifying the M4 Carbine M24 Blank Firing Adapter (BFA) in order to supply mechanical force to a piezoelectric element. The piezoelectric element produces an electrical pulse of voltage which can be used to charge up or power units in the field. The M200 (FIG. 5) blank cartridge is identified by a rose-petal closure of the cartridge case mouth. It also has an engraved knurl located ½ inch from the head of the cartridge case. The M200 blank is designed for simulated firing in training exercises and for saluting purposes. The M4A1 Carbine using the M23 (FIG. 6) Blank Firing Adapter (BFA) to fire M200 ammunition. The standard BFA consists of a frame housing assembly that attaches to the muzzle of an M4A1 Carbine. It also includes a restrictor stem that restricts the pressure pulse in order to correctly cycle the operating group to mimic normal weapon functionality typical to firing conventional ball round ammunition. Modified pressure testing was conducted to determine down bore pressure profiles for the M200. Peak pressure values at the muzzle were used to design the critical features of the present invention. The components developed under this invention include modifications to the standard M4 BFA (FIGS. 7-11). The present invention uses the same BFA frame assembly and weapon attachment method. The restrictor is altered to allow the high velocity/pressure gas to induce electrical energy in the piezoelectric material while also ensuring proper weapon cycling and functionality.

Figure 1:
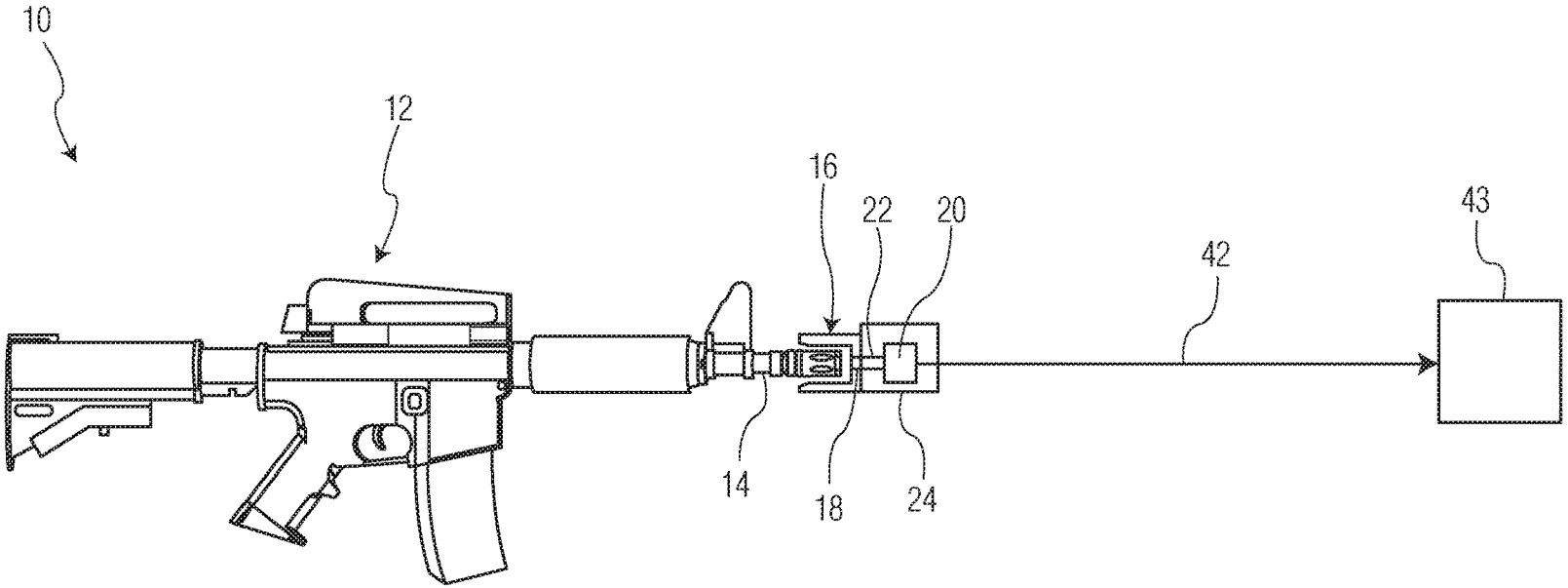
FIG. 1 is a schematic of one embodiment of an electromagnetic pulse gun.
Figure 2:
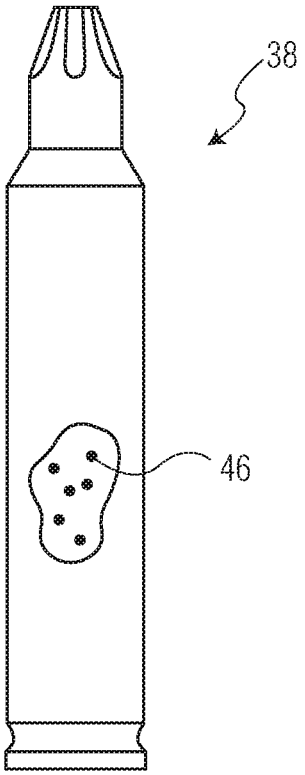
FIG. 2 is a side view, partially cut away, of one embodiment of a blank firearm cartridge.
Figure 3:
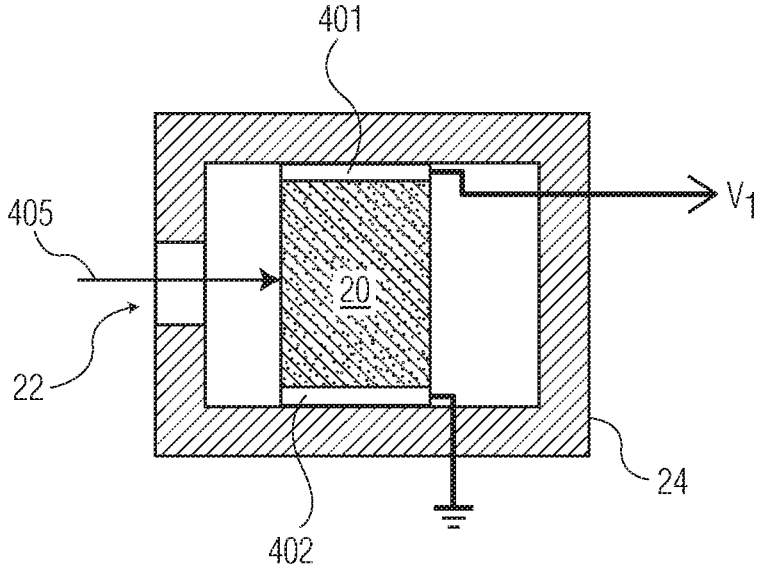
FIG. 3 is a cross sectional view of a piezoelectric element within a housing 24.

FIG. 1 is a schematic of one embodiment of a pulse gun 10. Gun 10 includes a rifle 12, for example, a standard issue military rifle or a commercial off-the-shelf rifle. The muzzle 14 of rifle 12 is fitted with a blank firing adapter (BFA) 16, The BFA 16 has a hole or orifice 18 on its axial centerline for release of high pressure propellant gas. The size and shape of orifice 18 may be designed to tailor the gas pressure and flow for optimum electrical power generation. A radial gas port (not shown) in the BFA 16 is formed perpendicular to the axial centerline to release the propellant gas after the electrical pulse has been generated, A blank firearm cartridge 38 (FIG. 2) containing propellant 46 may be fired in rifle 12 to generate high pressure propellant gas. Downstream of the BFA 16 is a ferroelectric generator 20. Generator 20 is mounted in a ferroelectric housing 24 (FIG. 3). Housing 24 may be directly fixed to BFA 16 by, for example, welding. Housing 24 includes an opening 22 in fluid communication with orifice 18 of BFA 16, In one embodiment, generator 20 includes multiple ferroelectric elements. Multiple ferroelectric elements may be electrically connected in series in housing 24. Each ferroelectric element may be a multi-stacked generator. By way of example only, a ferroelectric element having a 6 mm diameter and a 2.8 mm thickness can produce 12.53mJ of energy at a maximum pressure of 15,000 psi.

Figure 4:
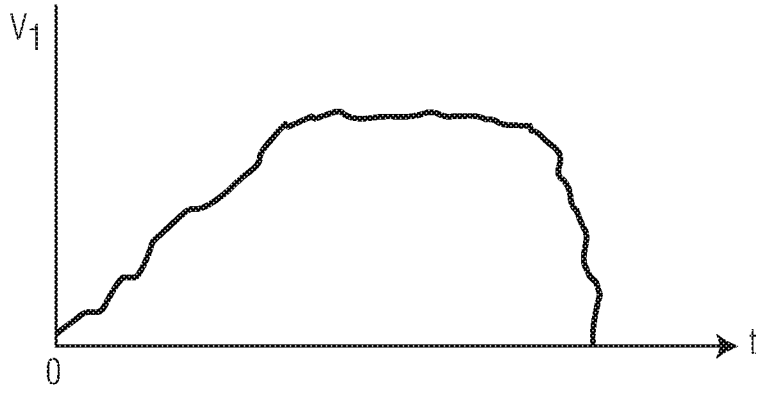
FIG. 4 is a hypothetical signal output from the piezoelectric elements.

The electrical output along 42 of the ferroelectric generator 20 may be amplified if desired or modified to change the electrical pulse length, or sharpen the rise time of the electrical pulse created by ferroelectric generator 20 which pulse waveform is a sharp rise pulse with an exponential decay. Known passive circuits may be used to change the pulse waveform, for example, a step recovery diode may be used to sharpen the pulse, and a capacitor and an inductor (both in parallel with the step recovery diode) may be used to control the decay rate of the pulse. The gun 10 is one man portable. Preferably, gun 10 weighs no more than 31 pounds. In FIG. 1, high pressure gases leave the BFA through hole 18 which is directly aligned with opening 22 in housing 24 (see also FIG. 3) to directly input the BFA's high pressure gases directly and fully into opening 22. The BFA if desired could be attached to housing 24 (welded perhaps in some embodiments). The BFA might even have a small pipe (not shown) to feed its output pressure gases directly into housing 24 through hole 22, to strike piezoelectric element 20 therein (also referred to within as a PEG). Pressure exerting onto the PEG could range from 5 kPSI to 12 kPSI, depending on the type of rifle or other weapon being used. The size of hole 22 leading onto the PEG could be roughly 3 mm in diameter. One type of PEG to employ could be a piezoelectric element number EC-64 from Exelis Incorporated or Harris Corporation. This component is made using a material called PZT, (Lead Zirconate Titanate), an electro ceramic material. The output voltage of the piezoelectric generator (PEG) could be approximately 30 kV. Arrow 405 illustrates gases symbolically being forced into housing 24 to strike piezoelectric element 20. In housing 24, the piezoelectric element 20 is bounded by two metal plates 401 and 402 where a voltage appears when pressure is applied to piezoelectric element 20. Voltage V1 which may be generated from the piezoelectric element 20 is shown in FIG. 4. Voltage V1 may if desired be wave shaped further. It might be processed into a more even pulse like formation, which pulse has a much steeper rise time and a flatter duration than in FIG. 4, e.g. these might be implemented completely by a Pomona electronic box model number 2901 with cover or maybe by a spark gap component. Output voltage after exiting a spark gap, could be roughly 22 kV, and duration of such pulse can vary from 1.7 ms to 2.9 ms (depending on voltages as may have been output from the PEG), The distance across a spark gap may be 7 mm for example. From here, the voltage would eventually variously dissipate through various elements of the entire system or be tapped at 42 as the desired output voltage which could be used to feed a unit 43. This invention may employ N-type connectors on all sub-components in the system. While this invention is a system that converts an existing barrel of a gun into a portable, voltage pulse creating device, the barrel of the existing gun can be of any caliber from an M4 rifle (which may have been shown in the Figures), to .50 caliber rifles, and possibly even tank gun barrels. It provides an explosive pulse power generator.

The invention has an M4A1 M24 Blank Firing Adaptor modification comprising of a frame housing assembly with modified restrictor stem intended to utilize the explosive pulse power of a blank ammunition to supply mechanical force to a ferroelectric element. No modification to the existing weapon system itself is needed. By way of results, analytical peak voltages were calculated to be 20 kV peak through a high impedance load using M4A1 Carbine/M 200 blank ammunition/BFA-PEG design. It might become a charging supply for directed energy sources. Multiple caliber/weapon applications include lightweight non-lethal weapons. No battery or power source requirement is needed to function the invention. It might be used for .50 caliber/12 gauge solutions as well.

A system here is shown of electrically connecting an explosive pulse power generator to a barrel plug/gas transport component. The barrel plug/gas transport device as was mentioned, plugs the rifle at the muzzle. Such barrel plug/ gas transport could be implemented by a blank firing adaptor (BFA) with a through-hole, as was shown in FIG. 8 for example. An explosive pulse power generator can be implemented variously but is not necessarily limited to a piezoelectric generator. A pulse forming network circuit example can be implemented, but is not necessarily limited to, a spark gap. A sequence of invention operation as was mentioned, could be described by: A BFA with a through-hole used to plug the muzzle of a similar caliber rifle barrel. A piezoelectric generator component is mounted onto the BFA. A spark gap may be mounted following the piezoelectric generator. A blank ammunition, similar to the caliber rifle, is loaded into the rifle. When the ammunition is ignited through pulling the trigger of the existing rifle, the high pressure gases pass the through-hole of the BFA to exert force onto the surface of the piezoelectric element. Inside the piezoelectric generator housing, the piezoelectric element converts this mechanical energy into electrical energy. If desired, the electrical voltage of such energy's pulse could enjoy a sharper rise time after traversing the breakdown voltage of a spark gap. Finally, the pulse signal is conveyed along 42 to power up a device such as at 43.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A portable electronic pulse generator comprising:

a rifle having a muzzle and capable of firing a blank cartridge containing propellant;

a blank firing adapter fixed to the muzzle of the rifle, the blank firing adapter including an axial gas exit orifice;

a piezoelectric generator aligned with the gas exit orifice;

a lead cable (42) electrically connected to the piezoelectric generator; and a unit (43) in series with said lead cable for storing or utilizing said electronic pulse, wherein the piezoelectric generator includes multiple ferroelectric elements, and further comprising a housing wherein the piezoelectric generator is mounted in the housing and the housing is fixed to the blank firing adapter, and further comprising a spark gap device electrically connected between the piezoelectric generator and the series unit.

2. A portable electronic pulse generator comprising:

a rifle having a muzzle and configured to fire a blank cartridge containing propellant;

a blank firing adapter fixed to the muzzle of the rifle, the blank firing adapter including an axial gas exit orifice;

a housing fixed to the blank firing adapter;

at least one piezoelectric generator disposed in the housing and aligned with the gas exit orifice;

a lead cable (42) electrically connected to the piezoelectric generator; and a unit (43) in series with said lead cable for storing or utilizing said electronic pulse, and further comprising a spark gap device electrically connected between the piezoelectric generator and the unit.

* * * * *